United States Patent [19]

Stavlo

[11] 4,295,431

[45] Oct. 20, 1981

[54] PALLET FOR PRESSURIZED GAS CYLINDERS

[75] Inventor: Lars G. Stavlo, Sigtuna, Sweden

[73] Assignee: AGA AB, Sweden

[21] Appl. No.: 96,689

[22] Filed: Nov. 23, 1979

[51] Int. Cl.[3] ..... B65D 19/00

[52] U.S. Cl. ..... 108/55.1; 220/1.5

[58] Field of Search ..... 108/55.1, 55.3, 56.1, 108/53.5; 220/1.5; 206/386, 598, 600

[56] References Cited

U.S. PATENT DOCUMENTS

| | | | |
|---|---|---|---|
| 2,975,929 | 3/1961 | Sjoblom | 220/1.5 X |
| 3,620,388 | 11/1971 | Mansson | 108/56.1 X |

FOREIGN PATENT DOCUMENTS

| | | | |
|---|---|---|---|
| 2318181 | 10/1974 | Fed. Rep. of Germany | 108/53.5 |
| 1262202 | 2/1972 | United Kingdom | 108/55.1 |

*Primary Examiner*—William E. Lyddane

*Attorney, Agent, or Firm*—Burge & Porter Co.

[57] ABSTRACT

A pallet for receiving, retaining and facilitating the transportation of pressurized gas cylinders includes three fixed, upstanding fence-like side walls and a pair of upper and lower gate members defining a fourth, openable side wall. The fixed upstanding side walls extend around three sides of the perimeter of a generally rectangular floor structure. Posts are provided at the four corners of the floor structure and extend upwardly above the top surface of the floor structure. The upper gate member is nonreleasably but movably connected to a first one of the posts and is releasably connected to a second one of the posts. The upper gate member is movable between a retaining position extending between the first and second posts, and a loading position nested within the first of the posts. The lower gate member is pivotally connected near its lower edge to the floor structure for movement between an upstanding retaining position and a downwardly extending loading position wherein the lower gate member forms a ramp to facilitate the loading and unloading of gas cylinders onto and off of the top surface of the floor structure. A latching collar is slidably carried on one of the first and second posts for engaging the lower gate member to releasably latch the lower gate member in its retaining position.

13 Claims, 9 Drawing Figures

PALLET FOR PRESSURIZED GAS CYLINDERS

BACKGROUND OF THE INVENTION

1. Field of the Invention

The present invention relates generally to material handling equipment and, more particularly, to a pallet for receiving, retaining and facilitating the transportation of pressurized gas cylinders.

2. Prior Art

Pressure vessels known as gas cylinders are commonly used to store, transport and dispense pressurized gases such as helium, nitrogen, oxygen, acetylene and the like. Conventionally configured pressurized gas cylinders have generally cylindrical upstanding side walls, generally round bottom walls, and tapered top walls provided with access openings. Gas cylinders are typically formed of welded steel construction. When loaded with compressed gas these cylinders may be quite heavy and awkward to handle. Safe handling necessitates that the cylinders be securely supported in upright positions during transport. Appropriate measures should be taken to assure that the cylinders are not banged about or dropped.

While devices of various types have been proposed for receiving, retaining and facilitating the transportation of individual gas cylinders, of pairs of gas cylinders and, in some instances, of groups of gas cylinders, no acceptable solution which will meet all of these needs has previously been proposed. Prior proposals have typically suffered from such drawbacks as posing difficulties for loading and unloading cylinders, failing to provide genuinely secure support of cylinders during transportation, and/or the lack of a capability to receive and properly support selectively small and large numbers of gas cylinders.

SUMMARY OF THE INVENTION

The present invention overcomes the foregoing and other drawbacks of prior proposals by providing a novel and improved pallet for receiving, retaining and facilitating the transportation of pressurized gas cylinders.

In accordance with the preferred practice of the present invention, a pallet is provided which has a generally rectangular floor structure with upstanding posts at the four corners of the floor structure. Three fixed upstanding side walls extend about three contiguous sides of the perimeter of the floor structure and are secured to the posts to provide a rigid support against which selectively small and large numbers of gas cylinders may be positioned and secured for transportation. A fourth openable side wall of the pallet is formed by upper and lower, movably mounted gate members. The upper gate member is non-removably secured to a first one of the posts and is releasably connectable to a second one of the posts to provide a top rail for retaining pressurized gas cylinders within the confines of the side walls of the pallet. The upper gate member is movable between a retaining position extending between the first and second posts, and a loading position wherein the upper gate member is nested within the first one of the posts. The lower gate member is pivotally secured near its lower edge to the floor structure, and is movable between an upstanding retaining position extending between the first and second posts, and a downwardly sloping loading position wherein it forms a ramp to facilitate the loading and unloading of pressurized gas cylinders onto and off of the elevated top surface of the floor structure.

A feature of a pallet embodying the preferred practice of the present invention is its simplicity of construction. The floor structure, the four posts, the three rigid upstanding side walls, and the two gate members which form the fourth side wall are all simply configured pieces which can be formed at relatively low cost and assembled with ease to provide an inexpensively constructed, yet genuinely sturdy pallet.

A further feature of a pallet embodying the preferred practice of the present invention lies in the ease with which the two gate members forming the openable fourth wall can be moved between loading positions wherein the space between the first and second posts is "open," and retaining positions wherein these members extend between the first and second posts to "close" the space therebetween. The upper gate member is moved from its retaining position to its loading position simply by raising it out of engagement with the second one of the posts, and continuing to raise the free end through a pivotal type movement until this member is vertically aligned with the first of the posts, whereupon the upper gate member is lowered into a nested position within the first post. The lower of the two gate members is releasably retained in an upstanding position by a collar which is slidably carried on one of the first and second posts. The lower gate member is rendered movable between its retaining and loading positions by simply raising the collar so that it no longer latches the lower gate member in its retaining position. When the lower gate member is pivoted into engagement with the ground or other surface underlying the pallet, the lower gate member forms a ramp for loading and unloading pressurized gas cylinders onto and off of the elevated upper surface of the floor structure. The two gate members may be returned to their retaining positions by reversing the foregoing steps.

A further feature of a pallet embodying the preferred practice of the present invention lies in the rigid rack-like structure provided by the three fixed upstanding side walls. Chains, ropes, or other conventional strap-like fastening devices may be used to facilitate the retention of selectively small and large numbers of gas cylinders against the rack-like structure provided by the three fixed upstanding side walls, whereby the pallet can selectively accommodate and properly support small and large numbers of pressurized gas cylinders. When gas cylinders are secured by this manner to the fixed side walls, the cylinders ordinarily do not exert forces on the gate member, thereby enabling the gate members to serve as a "back-up" or "secondary" means of support.

These and other features and a fuller understanding of the invention will be had by referring to the following detailed description and claims taken in conjunction with the accompanying drawings.

DESCRIPTION OF THE PREFERRED EMBODIMENT

Figure 1:
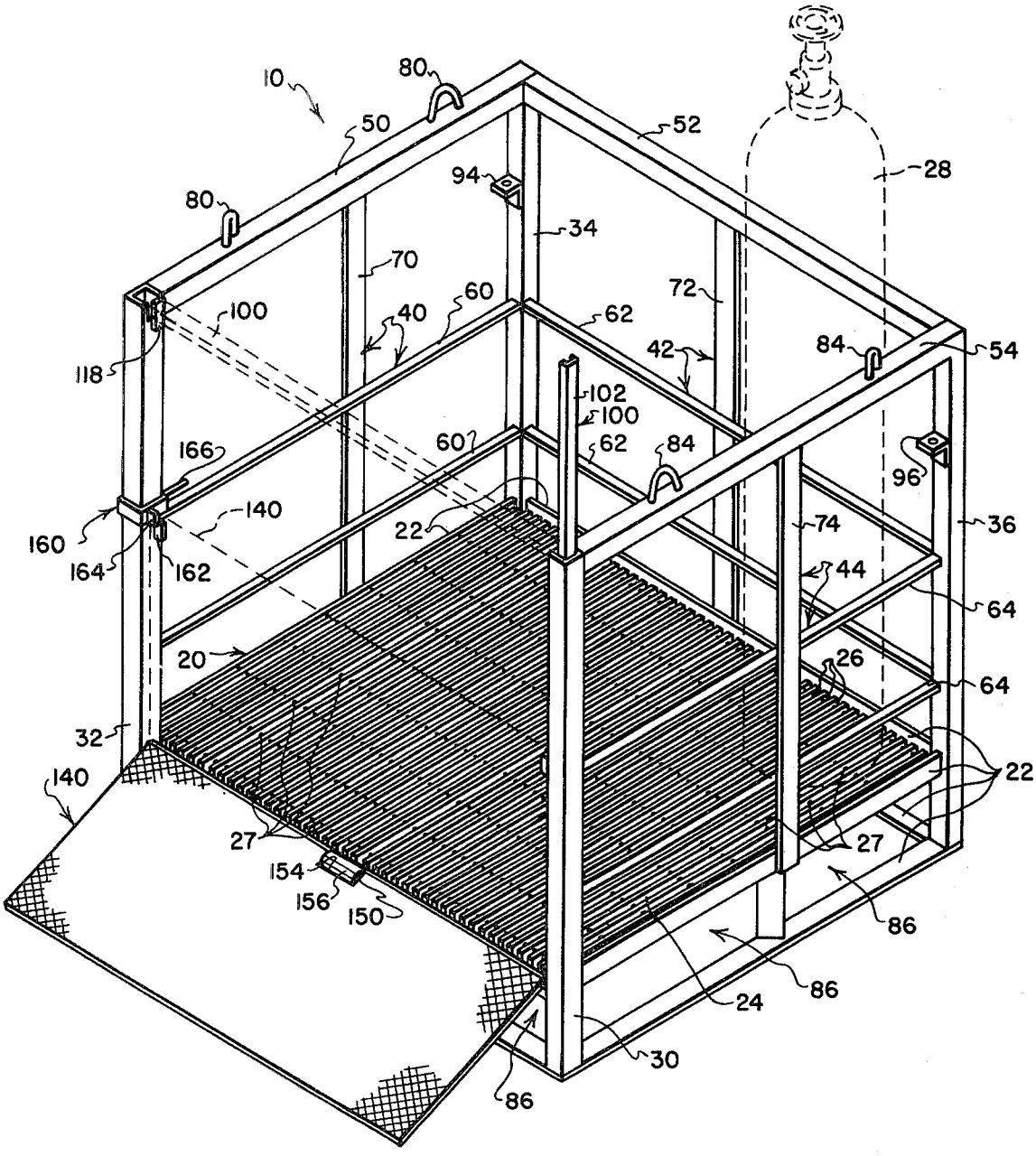
FIG. 1 is a perspective view of a pallet embodying the preferred practice of the present invention, the two gate members which form one of the side walls of the pallet being shown in solid lines in their loading positions and being shown in dotted lines in their retaining positions.
Figure 2:
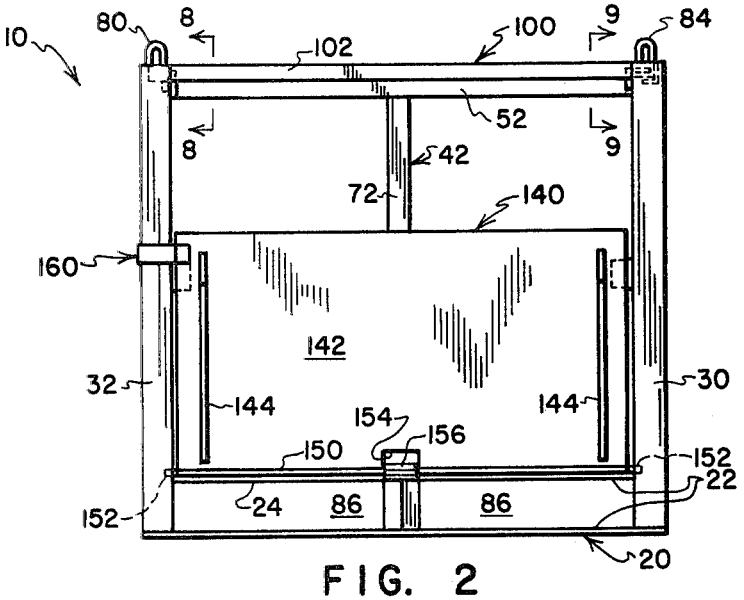
FIG. 2 is a front elevational view of the pallet of FIG. 1 with the gate members in their retaining positions wherein they extend between first and second posts of the pallet.
Figure 3:
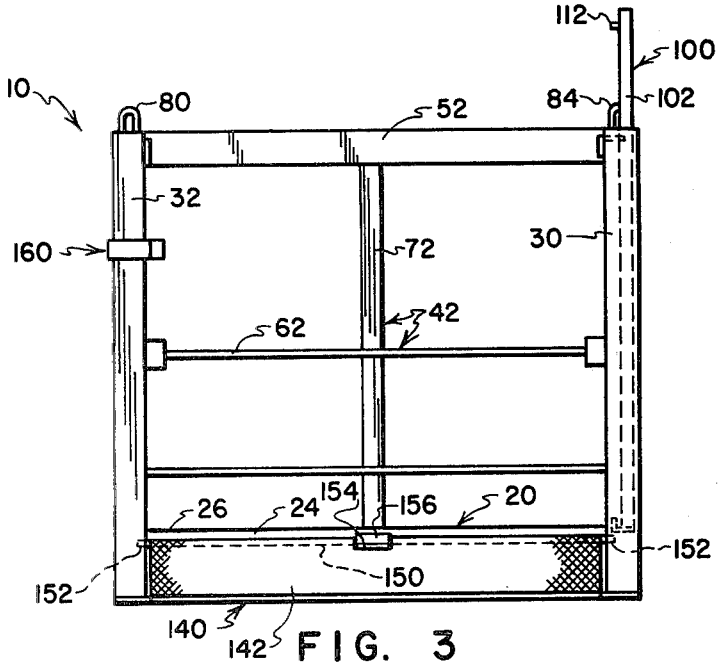
FIG. 3 is a front elevational view similar to FIG. 2 with the lower gate member pivoted downwardly to its loading position and with the upper gate member in its loading position nested within the first post.

Referring to FIGS. 1-3, a pallet embodying the preferred practice of the present invention is indicated generally by the numeral 10. The pallet 10 includes a floor structure 20, four upstanding posts 30, 32, 34, 36, three fixed upstanding side walls 40, 42, 44, and upper and lower movably mounted gate members 100, 140 which provide an openable fourth side wall. A feature of the invention lies in the manner in which the gate members 100, 140 are mounted for movement between loading positions, shown in solid lines in FIGS. 1 and 3, and retaining positions shown in dotted lines in FIG. 1 and in solid lines in FIG. 2. A latching collar 160 is slidably supported on the post 32 for releasably latching the lower gate member 140 in its retaining position.

The floor structure 20 includes a framework 22 extending perimetrically about and supporting an elevated grate 24. The grate 24 is formed from a grid of spaced, parallel-extending bars 26, which define a planar top surface on which pressurized gas cylinders may be supported, and an array of parallel-extending rods 27 which extend through aligned holes formed in the bars 26. One such cylinder is shown in phantom in FIG. 1, and is designated generally by the numeral 28.

The posts 30, 32, 34, 36 are formed from hollow, square steel tubing and are connected at their upper ends by top rails 50, 52, 54. The top rails 50, 52, 54 define upper portions of the fixed side walls 40, 42, 44. Cross members 60, 62, 64 extend between pairs of the posts 30, 32, 34. Upstanding braces 70, 72, 74 are provided toward the mid parts of the side walls 30, 32, 34. The cross members 60, 62, 64 and braces 70, 72, 74 serve to strengthen the side walls 40, 42, 44 and to retain pressurized gas cylinders within the confines of the pallet 10.

Two pairs of U-shaped eyelets 80, 84 are welded to the top rails 50, 54 to provide stable hoist connection points to enable the pallet 10 to be raised by a conventional hoist (not shown). The floor structure 20 is provided with side and end access openings 86 to permit the forks of a conventional lift truck (not shown) to engage the pallet 10 for transport. A pair of apertured brackets 94, 96 are provided on the posts 34, 36, as best seen in FIG. 1, for receiving conventional chains, ropes or other strap-like fastening devices (not shown) to enable pressurized gas cylinders to be held securely in place on the pallet 10. Such strap-like fastening devices cooperate with the fixed side walls 40, 42, 44 to provide a "primary" means of supporting pressurized gas cylinders within the pallet 10. When the gate members 100, 140 are in their retaining positions, as shown in FIG. 2, they cooperate with the fixed side walls 40, 44 to provide a "secondary" means of support for such cylinders.

Figure 7:
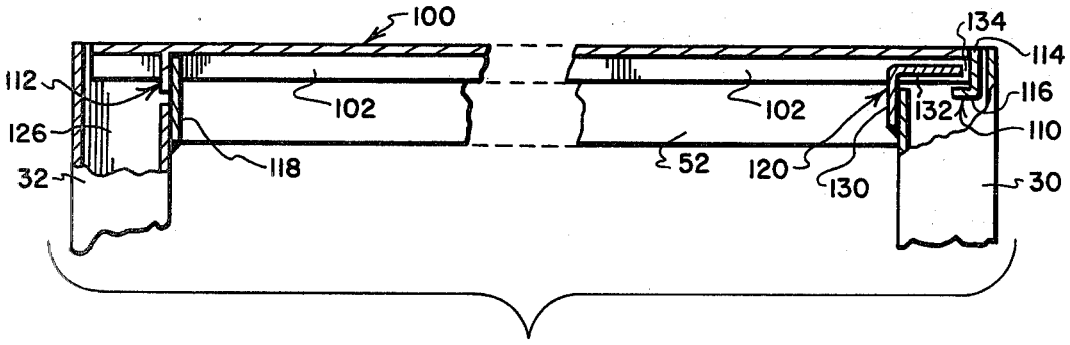
FIG. 7 is a foreshortened front elevational view, on an enlarged scale, of an upper portion of the pallet of FIG. 1 with the upper gate member in its retaining position, and with portions of the pallet being broken away and shown in cross-section to illustrate details of construction; and, FIGS. 8 and 9 are enlarged sectional views as seen from planes indicated by lines 8—8 and 9—9 in FIG. 2.
Figure 8:
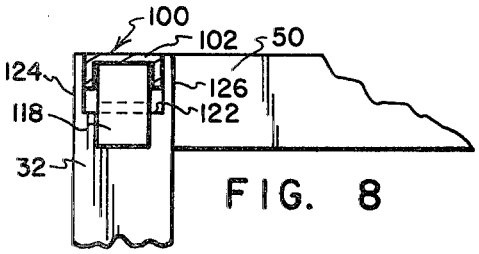
Figure 9:
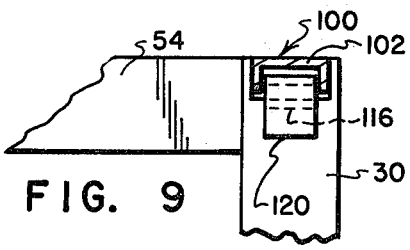

Referring to FIGS. 7-9, the upper gate member 100 has as its main component a channel shaped bar 102 capable of bridging the full distance between and overlying upper end portions of the first and second posts 30, 32. The upper gate member 100 not only serves to assist in retaining pressurized gas cylinders within the confines of the pallet 10 but also serves to rigidify the pallet 10 to maintain its shape and to prevent the side walls 40, 44 from bending inwardly when the pallet 10 is raised by a hoist connected to the eyelets 80, 84. Downwardly extending brackets 110, 112 depend from right and left end regions of the bar 102, as viewed in FIG. 7. The right bracket 110 is of L-shape, having a first leg portion 114 which extends substantially orthogonally relative to the plane of the bar 102, and a second leg portion 116 which extends substantially parallel to the plane of the bar 102. The left bracket 112 is of generally planar configuration and depends substantially orthogonally relative to the plane of the bar 102. An upstanding retaining bracket 118 is welded to the leg 32 and overlies the depending left bracket 112 when the upper gate member 100 is in its retaining position.

The upper end regions of the posts 30, 32 are open, and the brackets 110, 112 are receivable respectively within these open upper end regions. The first post 30 is provided with an L-shaped retainer member 120 which cooperates with the L-shaped bracket 110 to non-removably but movably interconnect the upper gate member 100 and the first post 30. The second post 32 is provided with a notch 122 which enables the free left end of the bar 102 to be releasably received between front and back wall portions 124, 126 of the post 32.

The non-removable mounting provided between the upper gate member 100 and the first post 30 is an important feature. As is seen in FIG. 7, the L-shaped retainer member 120 has a vertically extending leg 130 which is welded to the post 30. The member 120 also has a horizontally extending leg 132 which bridges much but not all of the open upper end of the post 30. A sufficient gap 134 is left between the distal end of the retainer member 120 and the inner wall of the post 30 to enable the channel-shaped bar 102 to be slided inwardly of the first leg 30 to a nested "loading" position shown in FIGS. 1 and 3. The overlapping engagement which takes place between the leg 132 of the retainer member 120 and the second leg portion 116 of the right bracket 110 when the upper gate member 100 is in its closed or "retaining" position, as shown in FIGS. 2 and 7, prevents the upper gate member 100 from being disconnected from the leg 30, thereby assuring that the upper gate member 100 will not be misplaced.

Figure 4:
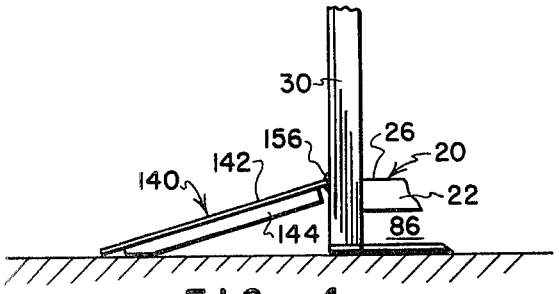
FIG. 4 is a side elevational view of a portion of the pallet of FIG. 1 with the lower gate member in its loading position.

Referring to FIGS. 2-4, the lower gate member 140 has as its main component a generally rectangular plate 142. A pair of rigidifying braces 144 are welded to the outer side of the plate 142. The braces 144 are tapered and do not extend the full height of the plate 142 so that, when the lower gate member 140 is lowered to its "open" or "loading" position as best seen in FIG. 4, the braces 144 will not prevent the plate 142 from providing a ramp which closely engages the ground or other surface underlying the pellet 10 to facilitate the loading of gas cylinders onto the elevated top surface of the floor structure 20.

A rod 150 is welded to the plate 142 and has opposed ends 152 which extend beyond the ends of the plate 142. Referring to FIG. 1, the ends 152 are journaled in holes formed in the posts 30, 32 to pivotally mount the lower gate member 140 adjacent the upper surface of the floor structure 20. A notch 154 is formed in the plate 142 at a location midway along the length of the rod 150. A tubular member 156 extends through the notch 154, journals the rod 150, and is welded to the floor structure 20 to assist in pivotally supporting the lower gate member 140 on the floor structure 20. A feature of this type of pivotal mounting system for the lower gate member 140 is that a lower gate member may be removed from the pallet 10 for maintenance simply by removing the weld which holds the tubular member 156 onto the floor structure 20, after which time the rod ends 152 may be removed, one at a time, from the posts 30, 32.

Figure 5:
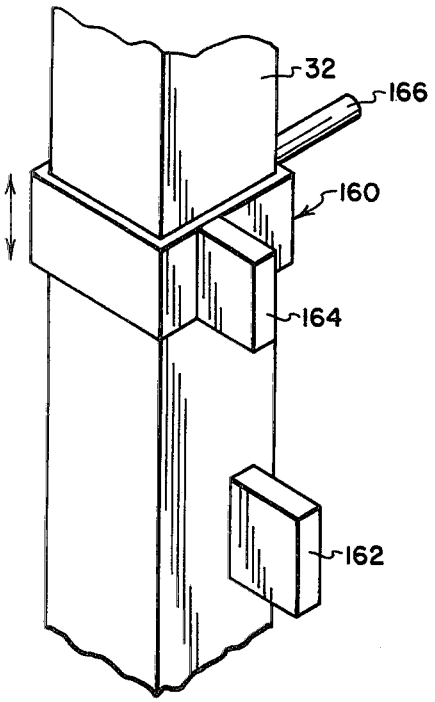
FIG. 5 is a perspective view, on an enlarged scale, of a portion of the pallet of FIG. 1 showing a movable latching collar carried on the second post, the collar being shown in its raised, unlatched position.
Figure 6:
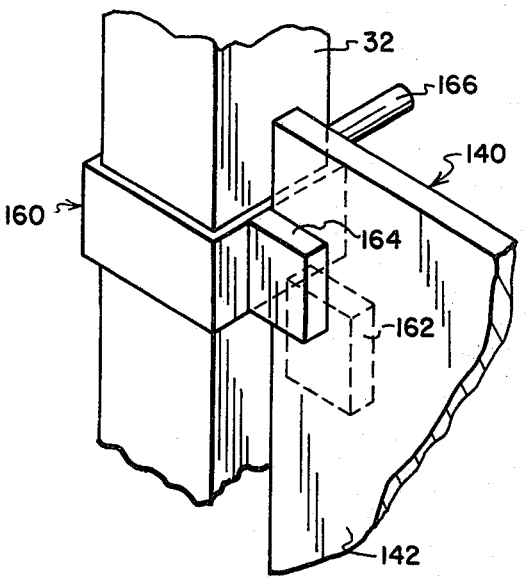
FIG. 6 is a perspective view, similar to FIG. 5, but with the latching collar in its lowered, latched position wherein it releasably latches the lower gate member in its retaining position.

Referring to FIGS. 5 and 6, a latching collar 160 is slidably supported on the second post 32. A first stop formation 162 is formed on the post 32 and extends in a direction toward the first post 30 to provide a surface against which the lower gate member 140 is engageable when the lower gate member 140 is moved to its retaining position. The collar 160 carries a second stop formation 164 which also projects in the general direction of the first post 30. The second stop formation 164 is configured to overlie the outer side surface of the lower gate plate 142 when the lower gate member 140 is moved to its retaining position. By this arrangement, the first and second stop formations 162, 164 are operable to sandwich the lower gate plate 142 therebetween when the lower gate member 140 is in its retaining position, whereby the lower gate member 140 is releasably latched in its retaining position.

A handle formation 166 is provided on the latching collar 160 to facilitate raising and lowering of the collar member along the length of the second post 32. The latching collar 160 is engageable with the upper of the two cross members 60 when the latching collar 160 is in its latching position to prevent the collar 160 from descending further along the length of the second post 32.

As will be apparent from the foregoing description, the pallet 10 provides an extremely simple, yet genuinely sturdy structure for receiving, retaining and facilitating the transportation of pressurized gas cylinders. The pallet 10 can be maneuvered either by hoist or by lift truck. The pair of gate members 100, 140 which form an openable side wall of the pallet 10 are non-removably mounted in a manner which assures long, trouble-free service and yet which provides ready access to the contents of the pallet 10.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A pallet, comprising:

(a) first structure defining a floor having an elevated top surface;

(b) second structure defining a substantially continuous side wall extending upwardly above the top surface of the floor structure and having opposite end formations leaving an open side wall portion therebetween, one of the end formations including a hollow upstanding post structure;

(c) first and second gate means, each being connected to at least one of the first and second structures and each being movable between a retaining position and a loading position providing substantially no obstruction to loading and unloading of the pallet through the open side wall portion;

(d) the first gate means including a bar-like member being non-removably connected to the hollow upstanding post structure, being operable when in its retaining position to bridge the open side wall portion so as to provide a continuation of upper portions of the continuous side wall, and being nested within the hollow upstanding post structure when in its loading position; and, (e) the second gate means being operable when in its retaining position to bridge the open side wall portion so as to provide a continuation of lower portions of the continuous side wall, and being operable when in its loading position to facilitate loading and unloading onto and off of the elevated top surface of the floor structure.

2. The pallet of claim 1 wherein a pair of interfitting parts, one being carried on the first gate means and the other being carried on said one end formation, form elements of a non-removable connection provided between the first gate means and said one end formation.

3. The pallet of claim 1 wherein:

(a) each of the end formations includes an upstanding post;

(b) the second gate means includes a platform like member which extends alongside at least a selected one of the posts when the second gate means is in its retaining position; and, (c) latching means is provided on at least said selected post for releasably retaining the second gate means in its retaining position.

4. The pallet of claim 10 wherein the latching means includes a collar which is slidably carried on said selected post for movement along the post between latching and unlatching positions.

5. A pallet comprising:

(a) first structure defining a floor having an elevated top surface;

(b) second structure defining a substantially continuous side wall extending upwardly above the top surface of the floor structure and having opposite end formations leaving an open side wall portion therebetween;

(c) first and second gate means, each being connected to at least one of the first and second structures and each being movable between a retaining position bridging the open side wall and a loading position providing substantially no obstruction to loading and unloading of the pallet through the open side wall portion;

(d) the first gate means being operable to bridge the open side wall portion so as to provide a continuation of upper portions of the continuous side wall;
(e) the second gate means being operable to bridge the open side wall portion so as to provide a continuation of lower portions of the continuous side wall;
(f) the first gate means being nestable within one of the end formations of the side wall when the first gate means is in its loading position;
(g) the first gate means being non-removably connected to said one end formation by a pair of interfitting parts, one being carried on the first gate means and the other being carried on said one end formation;
(h) said one end formation including a first hollow upstanding post within which the first gate means is nestable when the first gate means is in its loading position; and,
(i) the first gate means including a channel-shaped bar, the one part is an L-shaped bracket secured to the bar, and the other part is an L-shaped bracket secured to the first post.

6. The pallet of claim 5 wherein the other of the end formations includes a second hollow upstanding post, and the first gate means and the second post have interfitting formations which are cooperable to releasably connect the first gate means and the second post when the first gate means is in its retaining position.

7. A pallet comprising:
(a) first structure defining a floor having an elevated top surface;
(b) second structure defining a substantially continuous side wall extending upwardly above the top surface of the floor structure and having opposite end formations leaving an open side wall portion therebetween;
(c) first and second gate means, each being connected to at least a selected one of the first and second structures and each being movable between a retaining position bridging the open side wall portion and a loading position providing substantially no obstruction to loading and unloading of the pallet through the open side wall portion;
(d) the first gate means being operable to bridge the open side wall portion so as to provide a continuation of upper portions of the continuous side wall;
(e) the second gate means being operable to bridge the open side wall portion so as to provide a continuation of lower portions of the continuous side wall;
(f) the end formations including first and second spaced upstanding posts;
(g) the second gate means including a platform member which extends alongside at least a selected one of the first and second posts when the second gate means is in its retaining position;
(h) latching means being provided on at least said selected post for releasably retaining the second gate means in its retaining position;
(i) the latching means including a collar which is slidably carried on said selected post for movement along the post between latching and unlatchng positions;
(j) said selected post being provided with a first stop formation for engaging one side surface of the platform-like member when the second gate means is in its retaining position; and,
(k) the collar being provided with a second stop formation for engaging the opposite side surface of the platform-like member when the second gate means is in its retaining position;
(l) whereby the first and second stop formations are operable to releasably latch the platform-like member therebetween when the platform-like member is in its retaining position.

8. A pallet for receiving, retaining and transporting pressurized gas cylinders, comprising:
(a) structure defining a relatively rectangular floor having an elevated top surface;
(b) four posts extending upwardly from the four corners of the floor structure;
(c) three fixed side walls extending about the perimeter of the floor structure on three sides thereof and connecting with the four posts whereby the floor structure, the posts and the fixed side walls cooperate to define a rigid framework against which gas cylinders may be received and retained;
(d) upper and lower movably mounted gate member means for defining, respectively, upper and lower portions of a fourth side wall;
(e) upper gate mounting means mounting the upper gate member means for pivotal movement between a retaining position extending between two of the posts to a loading position nested vertically within one of the two posts; and,
(f) lower gate mounting means mounting the lower gate member means for pivotal movement between an upstanding retaining position extending between the two posts, and a downwardly inclining ramp-forming position for facilitating the loading of gas cylinders onto the upper surface of the floor structure.

9. The pallet of claim 8 wherein the upper and lower gate mounting means serve to non-removably connect their respective gate member means to the rigid framework.

10. The pallet of claim 8 wherein the upper gate mounting means includes a pair of interfitting parts, one being carried on the upper gate member means and the other being carried on said one post, and those interfitting parts form elements of a non-removable connection provided between the upper gate member means and said one post.

11. The pallet of claim 8 wherein the lower gate member means includes a platform-like member which extends alongside at least a selected one of the posts when in its retaining position, and latching means is provided for releasably retaining the lower gate member means in its retaining position.

12. The pallet of claim 11 wherein the latching means includes a collar which is slidably carried on said selected post for movement along the post between latching and unlatching positions.

13. The pallet of claim 12 wherein:
(a) said selected post is provided with a first stop formation for engaging one side surface of the platform-like member when the lower gate member means is in its retaining position;
(b) the collar is provided with a second stop formation for engaging the opposite side surface of the platform-like member when the lower gate member means is in its retaining position;
(c) whereby the first and second stop formations are operable to releasably latch the platform-like member therebetween.

* * * * *